US011021832B2

(12) United States Patent
Lee et al.

(10) Patent No.: US 11,021,832 B2
(45) Date of Patent: Jun. 1, 2021

(54) DETERGENT BOX AND LAUNDRY TREATING APPARATUS INCLUDING SAME

(71) Applicant: LG Electronics Inc., Seoul (KR)

(72) Inventors: Dongsoo Lee, Seoul (KR); Keunjoo Kim, Seoul (KR); Sangwook Lee, Seoul (KR); Kyosoon Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 16/349,125

(22) PCT Filed: Nov. 9, 2017

(86) PCT No.: PCT/KR2017/012655
§ 371 (c)(1),
(2) Date: May 10, 2019

(87) PCT Pub. No.: WO2018/088814
PCT Pub. Date: May 17, 2018

(65) Prior Publication Data

US 2019/0276974 A1 Sep. 12, 2019

(30) Foreign Application Priority Data

Nov. 10, 2016 (KR) ..... 10-2016-0149418

(51) Int. Cl.
*D06F 39/02* (2006.01)

(52) U.S. Cl.
CPC ..... *D06F 39/02* (2013.01)

(58) Field of Classification Search
None
See application file for complete search history.

(56) References Cited

U.S. PATENT DOCUMENTS 4,467,627 A * 8/1984 Platt ..... D06F 39/02 137/565.11
9,347,169 B2 * 5/2016 Ahn ..... D06F 58/203
(Continued)

FOREIGN PATENT DOCUMENTS

KR 2019990016521 5/1999
KR 1020060111286 10/2006
(Continued)

OTHER PUBLICATIONS

PCT International Search Report and Written Opinion in International Application No. PCT/KR2017/012655, dated Feb. 22, 2018, 8 pages (with English translation).
(Continued)

*Primary Examiner* — Cristi J Tate-Sims
(74) *Attorney, Agent, or Firm* — Fish & Richardson P.C.

(57) ABSTRACT

A laundry treating apparatus includes: a tub providing a space for storing water; a drum disposed in the tub in a rotatable manner to provide a space for storing clothing; a detergent box which is disposed outside the tub to provide a space for storing a detergent, and receives supply of water only from the tub; a tub through-hole passing through an inner circumferential surface of the tub; and a connection part having one side communicating with the tub through-hole and the other side communicating with the detergent box so that at least a portion of water moving in the direction of the inner circumferential surface of the tub due to a centrifugal force generated when the drum rotates is introduced into the detergent box, mixed with the detergent, and then discharged back to the inner circumferential surface of the tub again.

22 Claims, 11 Drawing Sheets

(56) References Cited

U.S. PATENT DOCUMENTS

| | | | | |
|---|---|---|---|---|
| 9,783,923 | B1 * | 10/2017 | Jo | D06F 39/026 |
| 2003/0145633 | A1 | 8/2003 | Merkle et al. | |
| 2011/0154865 | A1 * | 6/2011 | Lee | D06F 39/02 68/200 |
| 2014/0096572 | A1 * | 4/2014 | Kim | D06F 31/00 68/17 R |
| 2015/0059418 | A1 * | 3/2015 | Lee | D06F 39/02 68/17 R |
| 2016/0186370 | A1 * | 6/2016 | Kim | D06F 39/02 68/17 R |

FOREIGN PATENT DOCUMENTS

| | | |
|---|---|---|
| KR | 1020120073577 | 7/2012 |
| KR | 1020130025672 | 3/2013 |

OTHER PUBLICATIONS

Extended European Search Report in European Appln. No. 17868982.4, dated Jun. 9, 2020, 10 pages.

* cited by examiner

【FIG. 1】
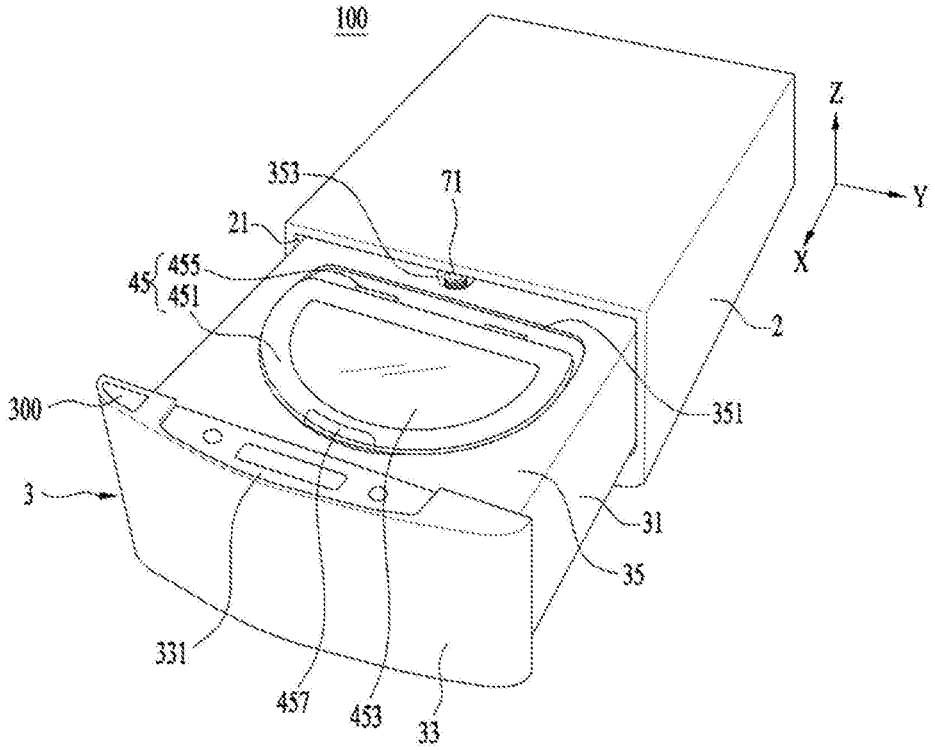

【FIG. 2】
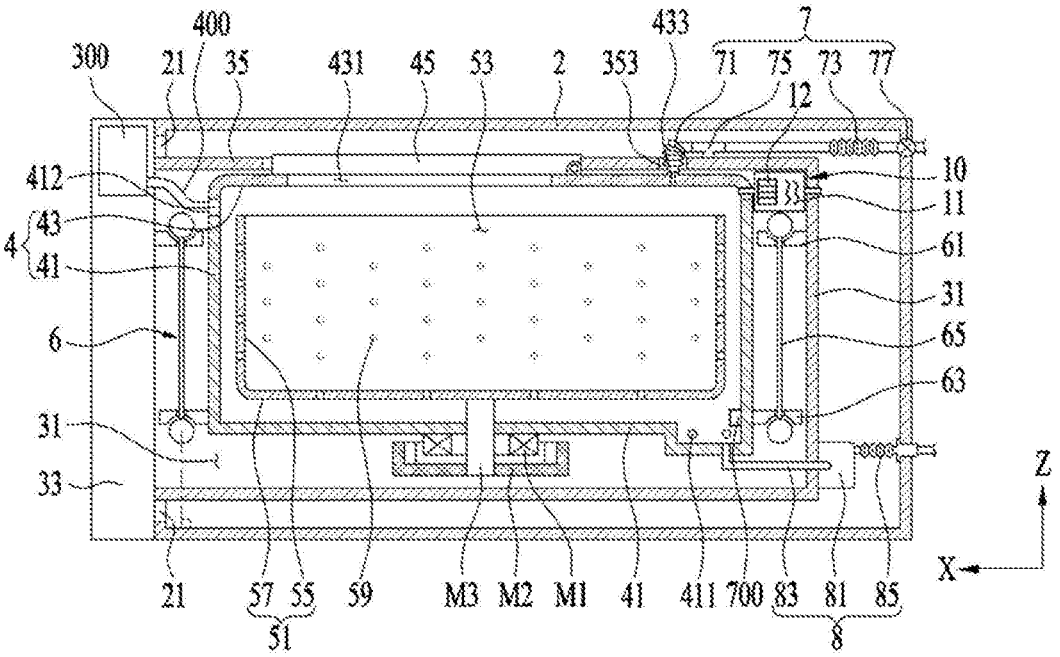

【FIG. 3】
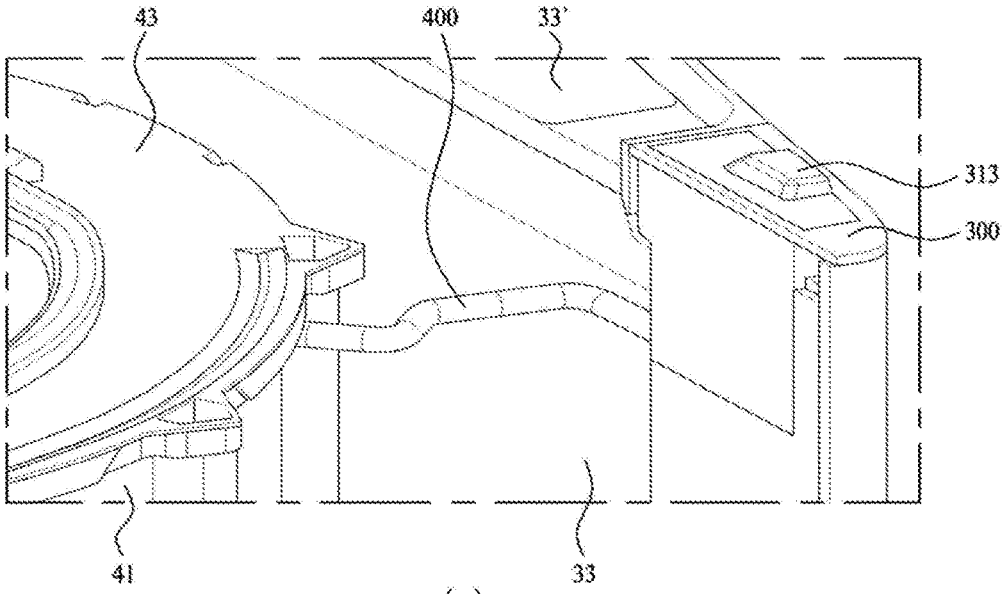
(a)
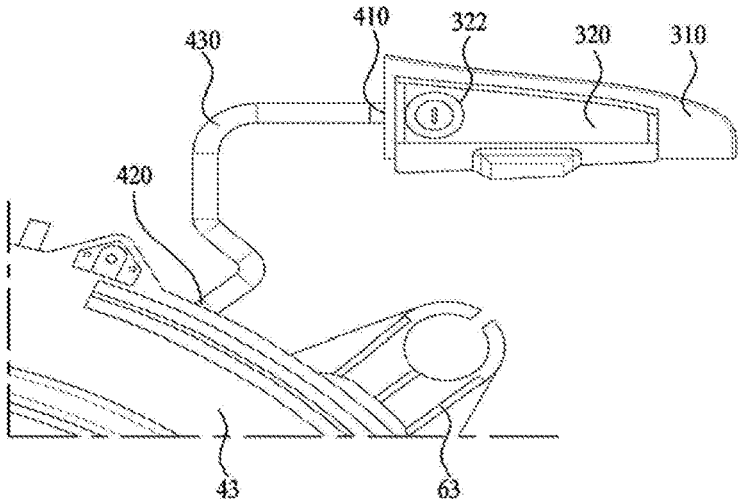
(b)

【FIG. 4】
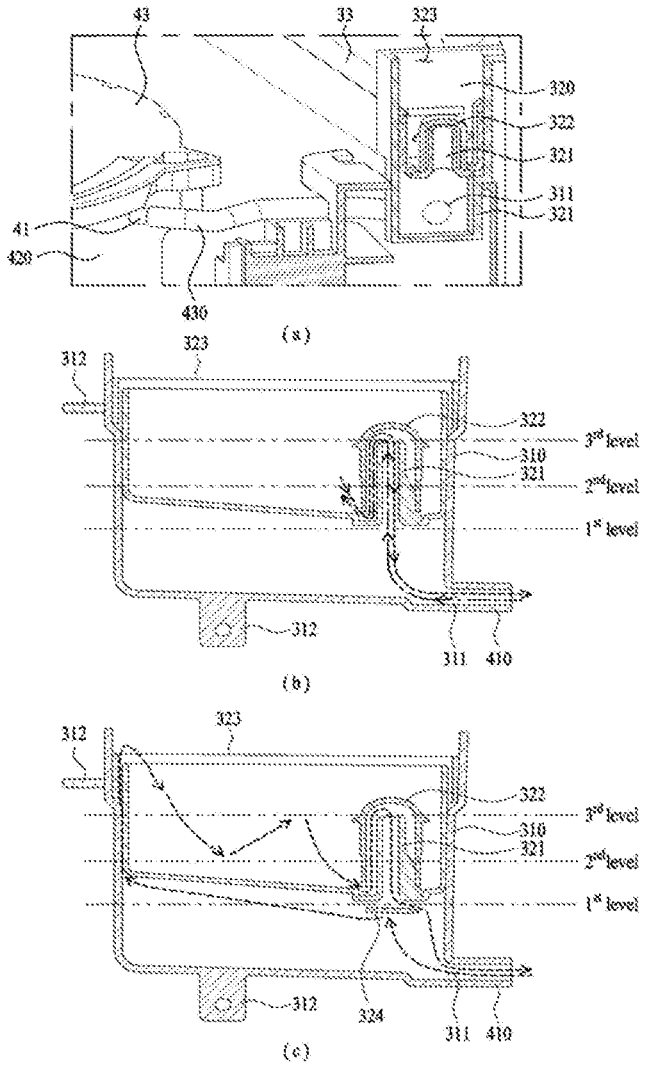

【FIG. 5】
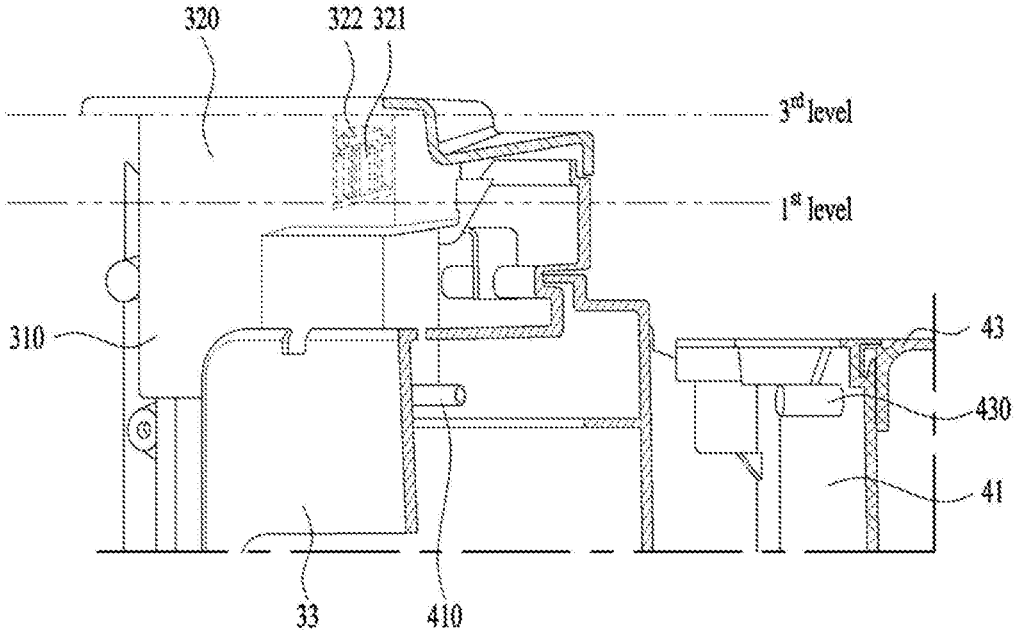

【FIG. 6】
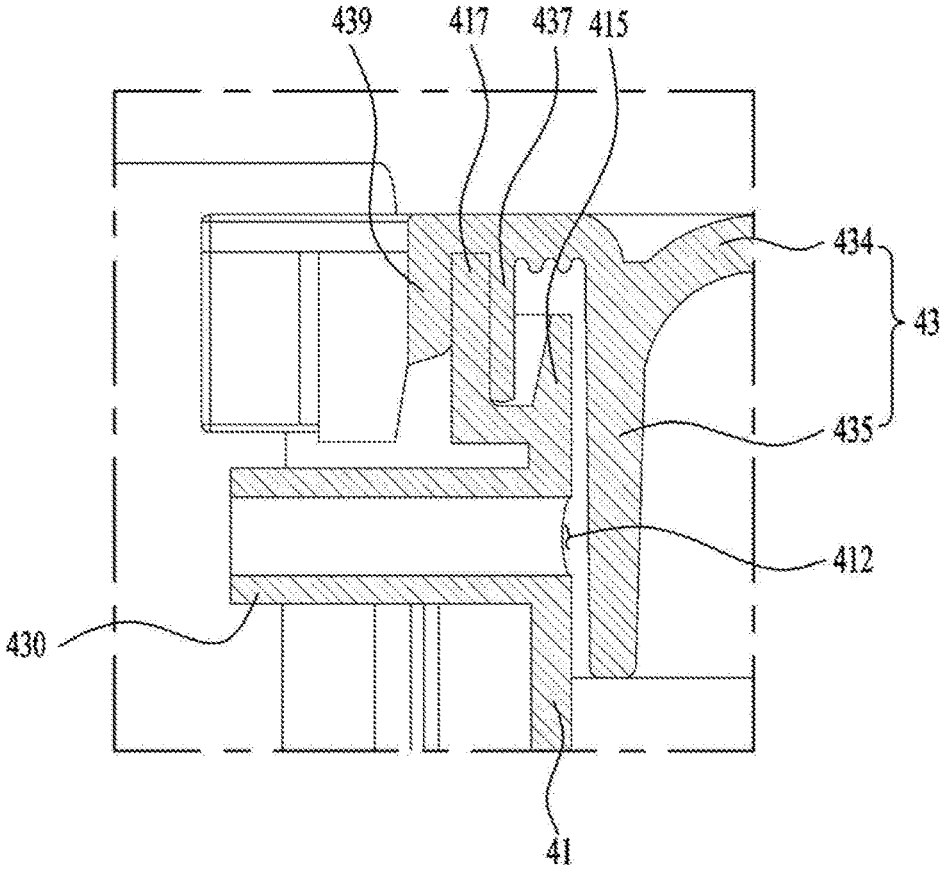

【FIG. 7】
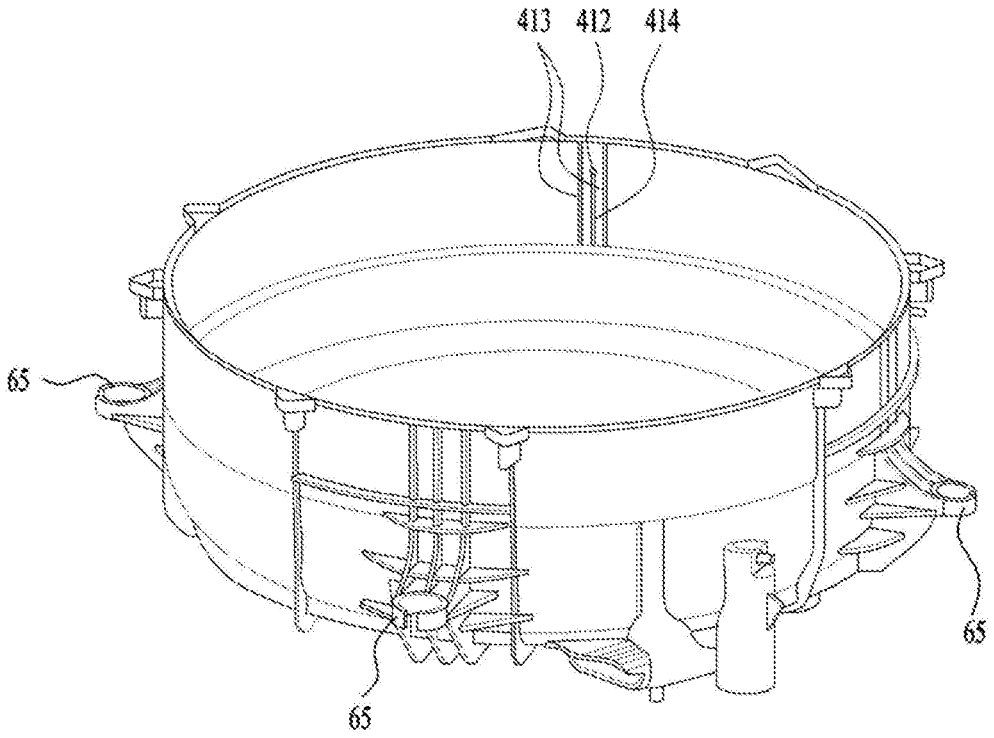

【FIG. 8】
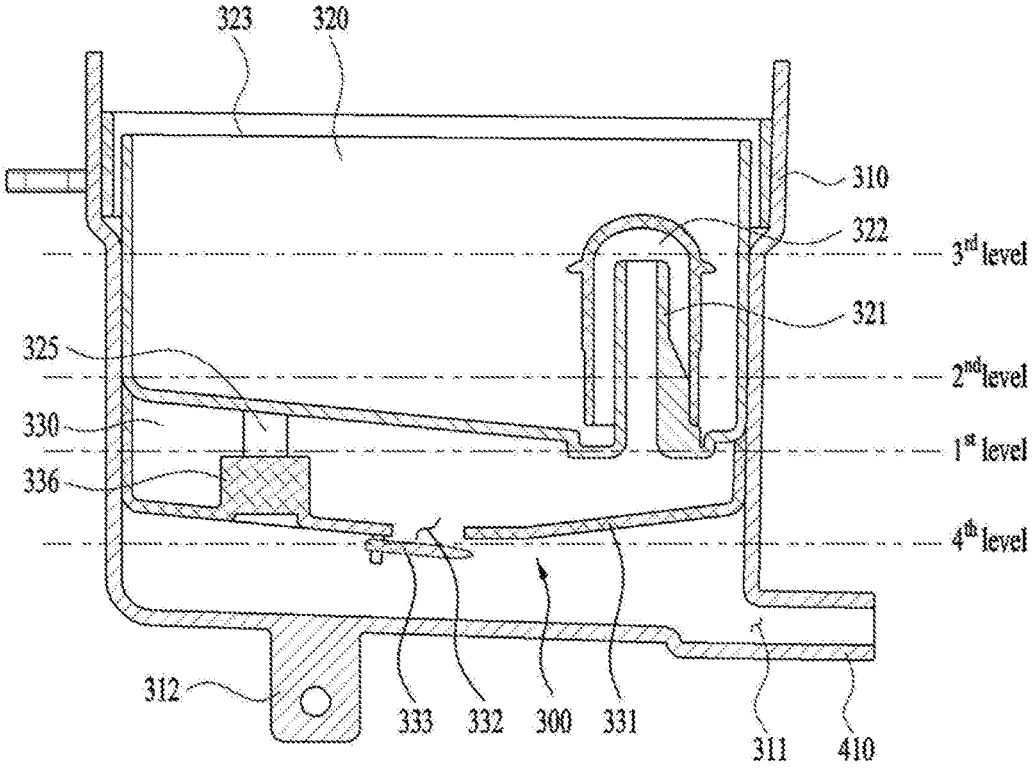

【FIG. 9】
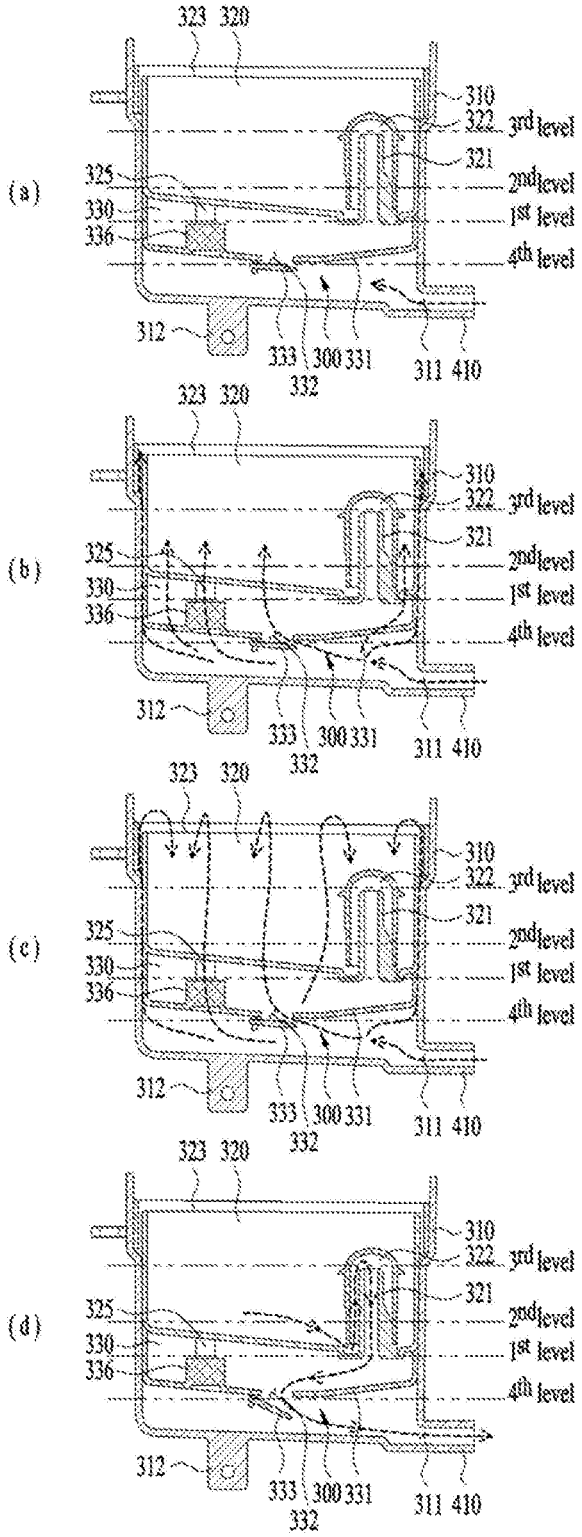

【FIG. 10】
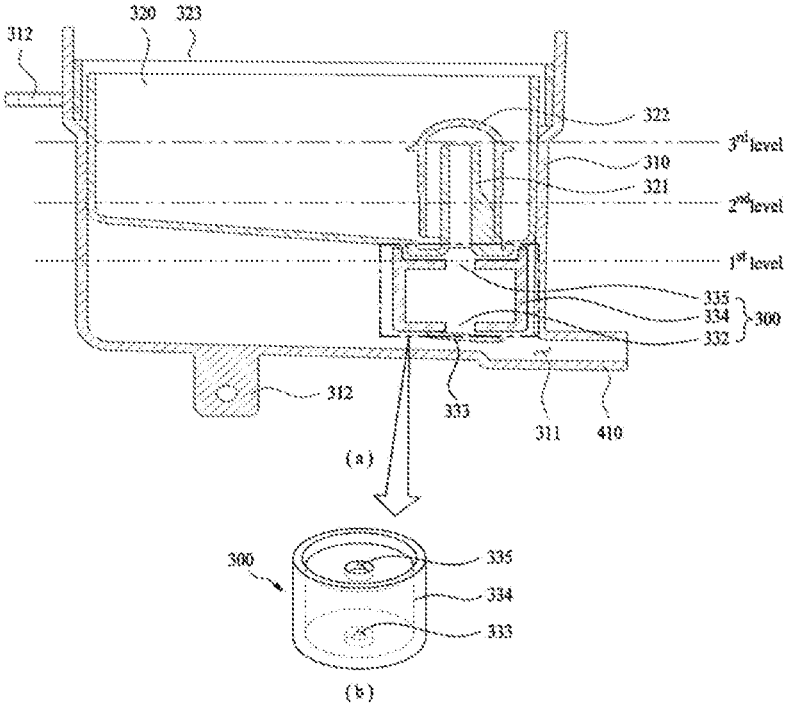

【FIG. 11】
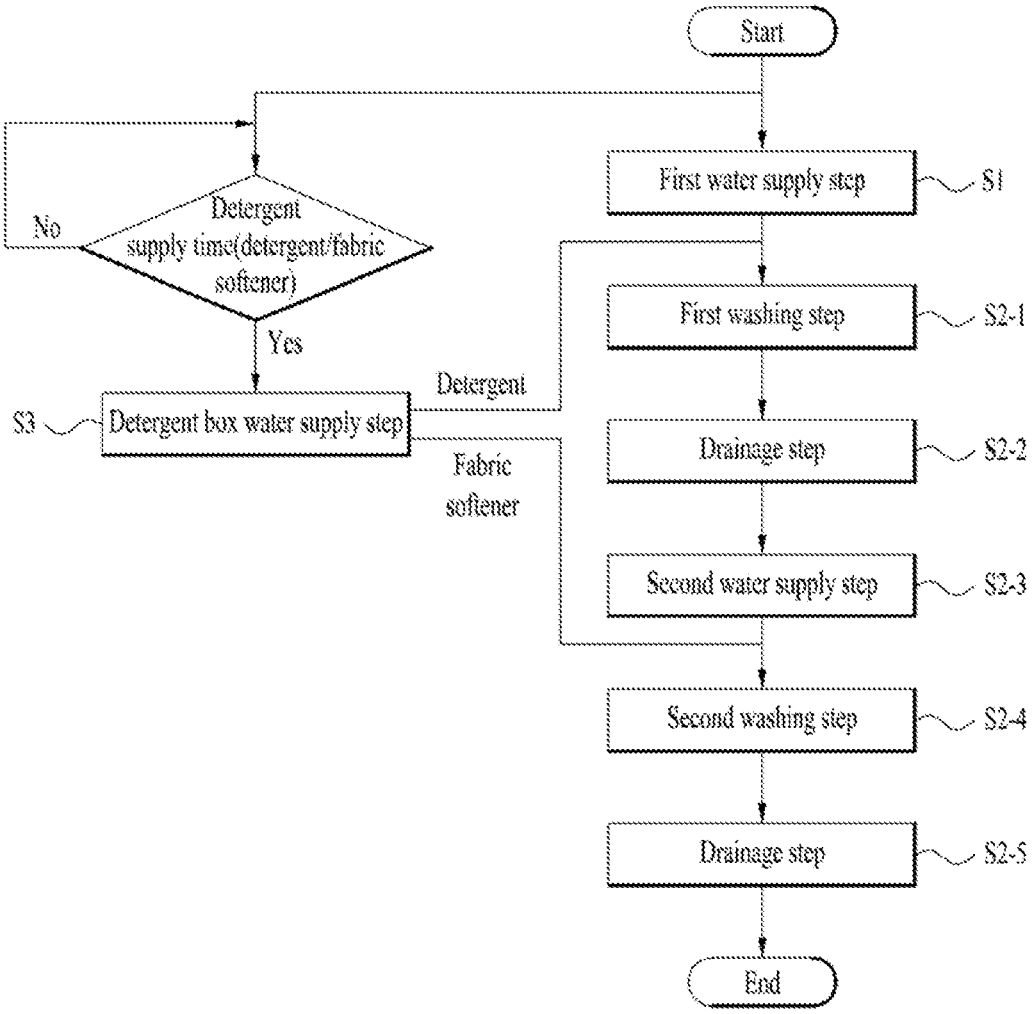

DETERGENT BOX AND LAUNDRY TREATING APPARATUS INCLUDING SAME

CROSS-REFERENCE TO RELATED APPLICATIONS

This application is a National Stage application under 35 U.S.C. § 371 of International Application No. PCT/KR2017/012655, filed on Nov. 9, 2017, which claims the benefit of Korean Application No. 10-2016-0149418, filed on Nov. 10, 2016. The disclosures of the prior applications are incorporated by reference in their entirety.

TECHNICAL FIELD

The present invention relates to a detergent box and a control method of a clothing processing apparatus including the same.

BACKGROUND ART

In general, the term "clothing processing apparatus" refers to an apparatus capable of performing washing and drying or either washing or drying of clothes and the like. Here, the clothing processing apparatus may perform only the washing or drying function, or both the washing function and the drying function. Recently, washing machines provided with a steam supply device to perform a refresh function, such as removing wrinkles, odors, static electricity, and the like from clothes have been spreading.

Conventional clothing processing apparatuses are divided into a front loading type and a top loading type according to a clothing retrieval direction. Also, clothing processing apparatuses are divided into a vertical type apparatus in which a pulsator or a washing tub is rotated, and a horizontal type in which a drum is rotated, by the manner of washing.

A typical example of the horizontal type is a drum washing machine or a drum dryer.

The size of such clothing processing apparatuses is gradually increasing in recent years to meet user demand. That is, the size of the washing machines for domestic use is gradually increasing.

Generally, each household is equipped with one high-capacity clothing processing apparatus. Accordingly, when the laundry is to be washed by classifying the clothes according to the types of the clothes, the clothing processing apparatus is used many times. For example, when where laundry such as adult clothes and laundry such as underwear or baby clothes need to be separately washed, the clothing processing apparatus will be used for washing of the latter laundry after washing of the former laundry is completed.

As a result, a long time and large energy consumption are required to perform the washing operation.

Further, it is not preferable in terms of energy saving to use a conventional large-size clothing processing apparatus in washing a small amount of clothing. The washing phase provided in most large-size clothing processing apparatuses presumes a large amount of laundry, and thus consumes a large amount of water. In addition, as a large-size drum or inner tub needs to be rotated, large power consumption takes place.

In addition, since the washing phase presumes a large amount of laundry, the washing time is relatively long.

In addition, since the large-size clothing processing apparatus is provided with the washing phase considering typical clothes, it may not be suitable for washing of delicate fabrics such as underwear or baby clothes.

Further, the large-size clothing processing apparatus is not suitable for a case where a small amount of laundry needs to be frequently washed. Consumers collect laundry for a few days or a longer period to wash the laundry at a time.

It is not good in terms of cleanliness to leave underwear and baby clothes unwashed for a long time. When the laundry is left for a long time, stains are stuck to the fabrics and thus the laundry is not thoroughly washed.

Accordingly, there is a need for a small clothing processing apparatus which has a much smaller capacity than the conventional large clothing processing apparatus.

However, even when small-size clothing processing apparatuses are used, it is not preferable in terms of space utilization and aesthetics to install two clothing processing apparatuses side by side in the same house.

In recent years, a drawer-type clothing processing apparatus has been introduced to address the above-described issues.

The conventional drawer-type clothing processing apparatus is provided with a drawer to be drawn in and out of a cabinet having an opening at the front thereof.

The drawer-type clothing processing apparatus may be used alone or in combination with another clothing processing apparatus arranged at the top or bottom thereof to wash a small amount of laundry and enhance space utilization.

The drawer-type clothing processing apparatus generally includes a tub configured to accommodate wash water in a drawer, and a drum rotatably arranged in the tub.

Since the drawer is arranged to be drawn out of the cabinet, a water supply unit configured to supply water to the tub and a drainage unit configured to drain water from the tub are generally provided at the rear of the drawer. Here, the term "rear" refers to a side to which the drawer is inserted into the cabinet.

Here, the drawer may be provided with a detergent box. In general, the detergent box of the conventional drawer-type clothing processing apparatus should be connected to a detergent watering pipe for supplying water, and also a detergent discharge pipe for discharging the detergent from the detergent box to the tub is separately provided.

In the case where the detergent box provided to the drawer is arranged on the rear side of the drawer, the user can reach the detergent box and introduce a detergent and a fabric softener into the detergent box only when the drawer is drawn out until a portion provided with the detergent box is exposed, which causes a great inconvenience to the user.

In the case where the detergent box is provided in front of the drawer, it is easy for the user to reach the detergent box. However, the detergent watering pipe and the detergent discharge pipe connected to the detergent box needs to be elongated. Thereby, the space where the detergent watering pipe and the detergent discharge pipe can be installed may be narrowed, or the introduction port of the drum and the tub may be partially blocked due to the detergent watering pipe and the detergent discharge pipe.

Further, in the case where a separate detergent watering pipe or detergent discharge pipe is provided to the detergent box, a separate valve for controlling the flow rates in the detergent watering pipe and the detergent discharge pipe, or a separate control means for opening and closing the valve needs to be provided, which causes inconvenience.

DISCLOSURE

Technical Problem

An object of the present invention devised to solve the problem lies on a laundry treating apparatus having a detergent box which is capable of incorporating a water supply pipe for supplying water to the detergent box and a drain pipe into one pipe.

Another object of the present invention is to provide a laundry treating apparatus having a detergent box which is capable of supplying water from a tub to the detergent box.

Another object of the present invention is to provide a laundry treating apparatus which uses rotation of a drum in supplying water to a detergent box and discharging a detergent.

Another object of the present invention is to provide a control method of a laundry treating apparatus capable of automatically introducing a detergent or a fabric softener to a tub by controlling revolutions per minute of a drum.

Technical Solution

The objects of the present invention can be achieved by providing a detergent box including a body portion providing a space for storing a detergent and having an opening at a top thereof, a housing allowing the body portion to be detachably accommodated therein, a housing through hole formed through a lower portion of the housing to allow water to be introduced or water and the detergent to be discharged together, a discharge pipe protruding from a lower portion of the body portion toward the opening and having a hollow for discharging the detergent, and a discharge pipe cover configured to guide the water and the detergent into the hollow when a reference amount or a larger amount of water flows into the body, a part of the discharge pipe being inserted into the discharge pipe cover, the detergent box further including a block unit communicating with the discharge pipe and having a predetermined space between a lower portion of the body portion and a bottom surface of the housing to prevent water introduced into the housing from contacting the discharge pipe.

In order to achieve the objects of the present invention, the block unit may include a block body accommodated in the housing, at least a part of the body portion being accommodated in the block body, and a block through hole formed in a bottom surface of the block body such that the detergent discharged from the discharge pipe is discharged into the housing.

In order to achieve the objects of the present invention, the block unit may further include a block check valve arranged outside the bottom surface of the block body to shield the block through hole.

In order to achieve the objects of the present invention, the block check valve may be a buoyancy type check valve having a specific gravity less than a specific gravity of water.

In order to achieve the objects of the present invention, the block check valve may be made of a rubber material.

In order to achieve the objects of the present invention, the block unit may include a block barrel extending from a lower end of the body portion having the discharge pipe, wherein the block barrel may include a communication hole provided at one end to communicate with the discharge pipe and a block through hole provided at an opposite end to communicate with the housing.

In order to achieve the objects of the present invention, the block unit may further include a block check valve arranged outside a bottom surface of the block body to shield the block through hole.

In order to achieve the objects of the present invention, when the body portion is accommodated in the housing, an outer circumferential surface of the body portion and a side surface of the housing may be spaced apart from each other by a predetermined distance, and the side surface of the housing may be arranged at a higher position than the opening such that water introduced into the housing flows into the body portion through the opening along the outer circumferential surface of the body.

The objects of the present invention can be achieved by providing a laundry treating apparatus including a tub providing a space for storing water, a drum rotatably arranged in the tub to provide a space for storing clothes, a detergent box arranged outside the tub to provide a space for storing a detergent and configured to be supplied with water only from the tub, a tub through hole formed through an inner circumferential surface of the tub, and a connection portion communicating with the tub through hole on one side thereof and with the detergent box on an opposite side thereof, such that at least a part of the water moving along an inner circumferential surface of the tub due to centrifugal force generated when the drum rotates is introduced into the detergent box, mixed with the detergent, and then discharged back to the inner circumferential surface of the tub The detergent box includes a body portion providing a space for storing a detergent and having an opening at a top thereof, a housing allowing the body portion to be detachably accommodated therein, a housing through hole formed through a lower portion of the housing to communicate with the connection portion, and a discharge pipe cover configured to guide the water and the detergent into the hollow when a reference amount of water or a larger amount of water flows into the body, a part of the discharge pipe being inserted into the discharge pipe cover, the detergent box further including a block unit communicating with the discharge pipe and having a predetermined space between a lower portion of the body and a bottom surface of the housing to prevent water introduced into the housing from contacting the discharge pipe.

In order to achieve the objects of the present invention, the block unit may include a block body accommodated in the housing, at least a part of the body portion being accommodated in the block body, and a block through hole formed in a bottom surface of the block body such that the detergent discharged from the discharge pipe is discharged into the housing.

In order to achieve the objects of the present invention, the block unit may further include a block check valve arranged outside the bottom surface of the block body to shield the block through hole.

In order to achieve the objects of the present invention, the block check valve may be a buoyancy type check valve having a specific gravity less than a specific gravity of water.

In order to achieve the objects of the present invention, when the body portion is accommodated in the housing, an outer circumferential surface of the body portion and a side surface of the housing may be spaced apart from each other by a predetermined distance, and the side surface of the housing may be arranged at a higher position than the opening such that water introduced into the housing flows into the body portion through the opening along the outer circumferential surface of the body.

In order to achieve the objects of the present invention, the detergent box may be arranged at a position higher than a maximum water level of water that can be accommodated in the tub when the drum is stopped.

In order to achieve the objects of the present invention, when an amount of water introduced into the detergent box through the connection portion is greater than or equal to a reference amount, the detergent box may discharge the detergent and water from the detergent box back to the connection pipe using a siphon effect.

In order to achieve the objects of the present invention, the water in the tub may be discharged to the connection portion and introduced into the detergent box by the centrifugal force only when the drum rotates at a speed higher than or equal to a first revolutions per minute (RPM).

In order to achieve the objects of the present invention, the tub through hole may be provided at a water level reached by the water in the tub when the drum rotates at the first RPM.

In order to achieve the objects of the present invention, the inner circumferential surface of the tub may be provided with first resistive ribs protruding from both sides of a surface having the through hole to generate resistance against water rotating on the inner circumferential surface of the tub such that the water flows into the through hole only when the drum rotates at a speed higher than or equal to a reference revolutions per minute (RPM).

In order to achieve the objects of the present invention, the inner surface of the tub may be provided with a second resistive rib arranged under the through hole to protrude toward a bottom surface of the tub.

In order to achieve the objects of the present invention, the block unit may include a block barrel extending from a lower end of the body portion having the discharge pipe, wherein the block barrel may include a communication hole provided at one end to communicate with the discharge pipe and a block through hole provided at an opposite end to communicate with the housing.

In order to achieve the objects of the present invention, the block unit may further include a block check valve arranged outside a bottom surface of the block body to shield the block through hole.

In order to achieve the objects of the present invention, the drawer may further include a drawer body for accommodating the tub and the drum, and a drawer panel arranged on the drawer body to open and close the opening, wherein the detergent box may be provided to the drawer panel.

Advantageous Effects

In a laundry treating apparatus having a detergent box according to the present invention, a water supply pipe for supplying water to the detergent box and a drain pipe may be integrated into one pipe, thereby improving space utilization.

In the laundry treating apparatus having a detergent box according to the present invention, water in the tub is supplied to the detergent box, and thus a detergent watering pipe connected to a water supply unit to supply water to the detergent box may be omitted.

In the laundry treating apparatus having a detergent box according to the present invention, a detergent contained in the detergent box may be discharged to a single pipe through which water is supplied from a tub.

In the laundry treating apparatus according to the present invention, only rotation of the drum may be used to supply water to the detergent box and discharge the detergent, and thus a separate control means or a flow rate control means may be omitted.

The present invention may provide a control method for a laundry treating apparatus capable of automatically introducing a detergent or a fabric softener into a tub by controlling revolutions per minute of a drum.

DESCRIPTION OF DRAWINGS

FIGS. 1 and 2 show a basic structure of a laundry treating apparatus according to the present invention.

FIG. 3 shows a structure in which a detergent box is connected to a tub.

FIG. 4 shows a structure in which the detergent box generates a siphon effect according to revolutions per minute of a drum.

FIG. 5 shows a position where the detergent box is installed.

FIG. 6 shows a cross-sectional view of a tub that blocks water from flowing into the detergent box due to vibration and temporary high-speed rotation of the drum.

FIG. 7 is a perspective view of the tub that blocks water from flowing into the detergent box due to vibration and temporary high-speed rotation of the drum.

FIG. 8 shows another embodiment of a detergent box in which a siphon effect is not interrupted.

FIG. 9 shows a flow direction of water supplied to the detergent box to maintain a siphon effect.

FIG. 10 illustrates another embodiment of a detergent box in which a siphon effect can be maintained.

FIG. 11 illustrates a control method capable of supplying a detergent and a fabric softener to the laundry treating apparatus of the present invention.

BEST MODE

Hereinafter, preferred embodiments of the present invention will be described in detail with reference to the accompanying drawings. The configuration and control method of a device described below are only for explaining embodiments of the present invention and are not intended to limit the scope of the present invention. The same reference numerals will be used throughout the specification to refer to the same or like parts.

As shown in FIGS. 1 and 2, the laundry treating apparatus 100 of the present invention may include a cabinet 2, a drawer 3 arranged to be withdrawable from the cabinet, a tub 4 arranged in the drawer to store water, and a drum 5 rotatably arranged in the tub to store clothes.

The laundry treating apparatus of the present invention shown in the figures is merely intended to illustrate the structure of the drawer-type washing machine and is not limited to the above-described configuration.

The laundry treating apparatus of the present invention may be provided in any structure as long as the drawer 3 can be drawn out of the cabinet 2, and may have any internal structure.

The cabinet 2 may be provided as a means for defining an outer appearance of the laundry treating apparatus, or may be provided simply as a space for accommodating the drawer 3. In any case, the front of the cabinet 2 may be provided with an opening 21 into which the drawer 3 is inserted.

The drawer 3 may include a drawer body 31 inserted into the cabinet 2 through the opening 21, a drawer panel 33 fixed to the front surface of the drawer body 31 to open and close the drawer body 31, and a drawer cover 35 for defining a top surface of the drawer body 31.

Since the drawer panel 33 is fixed to the front surface of the drawer body 31, the drawer panel 33 may also serve as a handle for drawing the drawer body 31 out of the cabinet 2.

The drawer panel 33 may be provided with a display unit 331 for inputting control commands related to operation of the laundry treating apparatus 100 and displaying a message related to the operation and status of the laundry treating apparatus for the user. The display unit 331 may include a display panel for displaying a view, and may further include a speaker (not shown) configured to generate warning sound, notification sound, and the like. The display unit 331 may also serve as a control panel that may be touched by the user to execute the clothing processing operation.

The drawer body 31 may be inserted into the cabinet 2 through the opening 21 and have any shape as long as it can provide a space for accommodating the tub 4. FIG. 1 shows an example of the drawer body 31 which has a hexahedron shape with a hollow interior.

As shown in FIG. 2, the tub 4 includes a tub body 41 positioned in the drawer body 31 to store water, and a tub cover 43 for defining the top surface of the tub body 41. The tub body 41 may have a cylindrical shape with an open top. A heater 411 for heating water may be provided in the tub body 41. The heater 411 may not only heat water but also generate steam to supply steam into the tub body 41.

The tub cover 43 may include an introduction port 431 allowing the inside of the tub body 41 to communicate with the outside of the tub body therethrough and a supply port 433 for introducing water into the tub body 41.

The drawer cover 35 may include a first through hole 351 and a second through hole 353 allowing the inside of the drawer body 31 to communicate with the outside. The first through hole 351 is provided for introduction and retrieval of clothes, and the second through hole 353 may be provided to supply water necessary for washing clothes.

The introduction port 431 may be provided below the first through hole 351 provided in the drawer cover, and the supply port 433 may be provided below the second through hole 353 of the drawer cover.

The introduction port 431 is a means for supplying clothes into the tub body 41 or withdrawing clothes from the tub body 41 to the outside of the tub body. The introduction port 431 may be opened or closed by a door 45.

The tub 4 having the above-described structure may be coupled to the drawer body 31 via a tub support portion 6. The tub support portion 6 may include a first support portion 61 provided to the drawer body 31, a second support portion 63 provided to the tub body 41, and a connection portion 65 for connecting the first support portion and the second support portion.

The connection portion 65 may include a first connection portion 651 seated on the first support portion 61, a second connection portion 653 for supporting the second support portion 63, and a bar 655 for connecting the first connection portion and the second connection portion.

The first connection portion 651 may be shaped to be seated in the first support portion 61 so as to be movable in the first support portion 61, and the second connection portion 653 may be shaped to support the second support portion 63 so as to be movable in the second support portion 63.

The bar 655 may be arranged to form a right angle with the bottom surface of the cabinet 2 (to be parallel to the height direction Z of the cabinet and to form a right angle with the bottom surface of the drawer).

In the present invention, at least three tub support portions 6 are provided to couple the tub body 41 with the drawer body 31, and the bar 655 is arranged to form a right angle with the bottom surface of the cabinet. Accordingly, the spacing between the tub cover 43 and the drawer cover 35 may be widened, compared to a case where the bar 655 is inclined at a predetermined angle with respect to the Z axis.

The tub support portion 6 provided in the present invention may minimize the possibility that the tub cover 43 will collide with the drawer cover 35 even when the tub body 41 vibrates inside the drawer body 31.

When the bar 655 is arranged to be perpendicular to the bottom surface of the drawer, at least one of the first support portion 61 and the second support portion 63 may be detachably attached to the drawer body 31.

When the tub support portion 6 has at least three support portion and both the first support portion 61 and the second support portion 63 are arranged so as not to be separated from the drawer body 31, an operator who fixes the drawer body 31 to the drawer body 31 needs to insert the tub body 41 into the drawer body 31 such that the first support portion 61 does not interfere with the second support portion 63 and then rotate the tub body 41 to position the first connection portion 651 on the vertical line passing through the first support portion 61 to couple the first connection portion 651 to the first support portion 61.

Arranging the bar 655 of the tub support portion at a right angle with respect to the bottom surface of the drawer may minimize the spacing S between the outer circumferential surface of the tub body 41 and the inner circumferential surface of the drawer body 31, thereby minimizing the volume of the laundry treating apparatus 100. However, such arrangement may deteriorate assimilability of the first connection portion 651 and the first support portion 61 which are connected through the above-described process. This disadvantage may be overcome by detachably providing the first support portion 61 to the drawer body 31.

The drum 5 arranged in the tub 4 may be provided with a cylindrical drum body 51 having an opening 53 at the top thereof. Since the opening 53 is located below the introduction port 431, clothes introduced through the introduction port 431 may be supplied to the drum body 51 through the opening 53.

The bottom surface 57 and the circumferential surface 55 of the drum body 51 may be provided with a plurality of drum through holes 59 allowing the inside of the drum body 51 to communicate with the tub body 41 therethrough.

The drum body 51 is rotated in the tub body 41 by a drive unit M. The drive unit M may include a stator M1 disposed outside the tub body 41 and fixed to the bottom surface the tub body, a rotor M2 rotated by a rotating field provided by the stator, and a rotary shaft M3 arranged to penetrate the bottom surface of the tub body 41 to connect the bottom surface 57 of the drum and the rotor M2. In this case, the rotary shaft M3 may be arranged to form a right angle to the bottom surface of the tub body 41.

The laundry treating apparatus 100 having the above-described structure supplies water to the tub 4 through a water supply unit 7 and discharges water stored in the tub 4 to the outside of the cabinet 2 through a drainage unit 8.

As shown in FIG. 2, the water supply unit 7 may include a first water supply pipe 71 connected to the supply port 433 provided in the tub cover, a second water supply pipe 73 connected to a water supply source located outside the cabinet, and a connection pipe 75 fixed to the tub cover 43 and connecting the first water supply pipe and the second water supply pipe.

The first water supply pipe 71 connects the supply port 433 and the connection pipe 75 through the second through hole 353 provided in the drawer cover 35, and may be formed as a corrugated tube to prevent the water supply pipe 71 from being separated from the connection pipe 75 when the tub 4 vibrates (see FIG. 3).

The second water supply pipe 73 may also be formed as a corrugated tube to prevent the second water supply pipe 73 from being separated from the connection pipe 75 when the drawer 3 is drawn out of the cabinet 2. The second water supply pipe 73 is opened and closed by a water supply valve 77, which is controlled by a controller (not shown).

Unlike the example shown in FIG. 2, the water supply unit 7 may be provided with a single water supply pipe connecting the water supply source (not shown) arranged outside the cabinet and the supply port 433 provided in the tub cover. In this case, the water supply pipe may be formed as a corrugated tube.

The drainage unit 8 may include a drain pump 81 fixed to the drawer body 31, a first drain pipe 83 for guiding water from the tub body 41 to the drain pump 81, and a second water supply pipe 85 for guiding the water discharged from the drain pump 81 to the outside of the cabinet 2. In this case, the second drain pipe 85 may be provided as a corrugated tube.

In the laundry treating apparatus 100 having the above-described structure, clothes are introduced into the drum 5, water and a detergent are supplied to the tub 4, and then the drum 5 is rotated through the drive unit M to wash the clothes.

The laundry treating apparatus 100 of the present invention having the above-described structure may further include a hot air supply unit 10 configured to supply hot air into the tub 4 or the drum 5. That is, the hot air supply unit may be provided separately from the heater 411 to supply hot air to the tub 4 or the drum 5. The hot air supply unit 10 may be supplied with water from the water supply unit 7 and heat the supplied water to supply the water to the tub 4 or the drum 5. The hot air supply unit 10 may further include a hot air heater 11 configured to heat water in the hot air supply unit to generate steam, and a blowing fan 12 configured to supply hot air to the tub 4 or the drum 5.

However, the hot air supply unit 10 may be configured in a circulation structure as long as it can supply hot air into the drum 5.

In addition, a temperature sensor 700 configured to measure the temperature of water or air contained in the tub may be provided in the tub 4. The temperature sensor 700 may be arranged near the heater 411 to check the temperature of the heater 411 immediately. The temperature sensor 700 may be a thermistor (NTC, PTC, CTR) thermal ferrite, or a metal thermometer.

The temperature sensor 700 may be provided at any position and with any configuration as long as it can measure the temperature of the inside of the tub 4 or the drum 5.

The laundry treating apparatus 100 of the present invention may further include a detergent box 300 arranged outside the tub 4 to provide a space for storing the detergent.

The detergent box 300 may be arranged to receive water only from the tub 4, not from the water supply unit 7. Accordingly, elements such as a flow passage and a valve for directly connecting the detergent box 300 and the water supply unit 7 may be omitted.

In addition, the detergent box 300 may be provided to the drawer 3 or the cabinet 2. That is, the detergent box 300 may be arranged outside the tub 4 and may be arranged anywhere as long as it can supply the detergent into the tub 4. The detergent box 300 may be provided to the drawer 3 to allow the user to easily access the detergent box 300, considering that the drawer 3 is drawn out of the cabinet 2. When the detergent box 300 is provided to the drawer 3, the detergent box 300 may be provided to the drawer panel 33. This is because the drawer panel 33 is provided at the forefront of the laundry treating apparatus 100, and allows the user to most easily reach the detergent box 300.

Since the detergent box 300 is supplied with water only from the tub 4, the laundry treating apparatus 100 of the present invention may further include a structure capable of supplying water from the tub 4 to the detergent box 300 and discharging the detergent from the detergent box 300 into the tub 4.

To this end, the tub 4 may include a tub through hole 412 formed through an inner circumferential surface of the tub 4 and may further include a connection portion 400 communicating with the tub through hole 412 on one side thereof and with the detergent box 300 on an opposite side thereof.

Accordingly, the detergent box 300 may be supplied with water through the connection portion 400, mix the supplied water with the detergent, and then discharge the mixture to the tub 4.

Hereinafter, a description will be given of a manner in which water is supplied to the detergent box 300 and water and the detergent are discharged back to the tub 4 according to the above-described configuration, with reference to FIG. 2.

The drum 5 rotates when the laundry treating apparatus 100 performs at least one of a washing cycle for removing foreign substances from the clothes and a rinsing cycle for washing away the detergent and foreign substances from the clothes.

When the drum 5 rotates, the water in the tub 4 is moved along the inner circumferential surface of the tub 4 by the centrifugal force, and the water level on the inner circumferential surface of the tub 4 gradually increases.

When the drum 5 is rotated at a higher speed, the centrifugal force is further increased, and thus water in the tub 4 further moves along the inner circumferential surface of the tub 4 and flows into the connection portion 400 to reach the detergent box 300.

When rotation of the drum 5 is maintained, water supplied into the detergent box 300 is increased and mixed with the detergent. Thereafter, when the rotation speed of the drum 5 is reduced or the drum 5 is stopped, the water level on the inner circumferential surface of the tub 4 is lowered. Then, the detergent and water in the detergent box 300 may be discharged into the tub 4 through the connection portion 400.

Accordingly, since the detergent can be automatically supplied from the detergent box 300 to the tub 4, a separate control means for supplying water to the detergent box 300 or adjusting the amount of the detergent to be discharged may be omitted.

The detergent stored in the detergent box 300 may correspond to at least one of a laundry detergent for removing foreign substances from the clothes and a fabric softener for increasing the degree of flexibility of the clothes. Accordingly, the detergent stored in the detergent box 300 should be appropriately introduced in the washing cycle, in which the laundry treating apparatus 100 removes foreign substances from the clothes, or the rinsing cycle, in which foreign substances and the detergent are washed away from the clothes after the washing cycle is completed, according to the type of the detergent.

That is, water in the tub 4 should be supplied to the detergent box 300 at an appropriate time, and the water and detergent in the detergent box 300 should be supplied to the tub 4 at an appropriate time. In other words, even if there is water contained in the tub 4, the water inside the tub 4 should not be indiscriminately supplied to the detergent box 300, and the detergent in the detergent box 300 should not be indiscriminately supplied into the tub 4.

To this end, the tub through hole 412 may be arranged at a position higher than the maximum level at which water can be accommodated in the tub 4, and the detergent box 300 may be arranged at a position higher than the maximum level at which water can be accommodated in the tub 4 when the drum 5 is stopped.

If the tub through hole 412 is provided at the lower end of the tub 4 or the detergent box 300 is arranged at the position of the bottom surface of the tub 4, water may be supplied to the detergent box 300 immediately after water is supplied to the tub 4 through the water supply unit 7, and the detergent in the detergent box 300 may be constantly discharged to the tub 4.

If the connection portion 400 is arranged to communicate with the upper end of the detergent box 300, the water and the detergent in the detergent box 300 cannot be supplied to the tub 4 when rotation of the drum 5 is reduced after the water is supplied to the detergent box 300.

Accordingly, the connection portion 400 may be arranged to communicate with a lower portion of the detergent box 300.

FIG. 3 shows the tub 4 and the detergent box 300 provided at the upper end of the drawer panel 33.

Referring to FIG. 3(*a*), the connection portion 400 is arranged to allow the upper end of the tub body 41 to communicate with the lower end of the detergent box 300 therethrough.

The detergent box 300 may be provided on one side of the upper end of the drawer panel 33 to avoid interference with the display unit 331 and may be arranged above the maximum water level of water accommodated in the tub body 41.

Referring to FIG. 3(*b*), the top of the detergent box 300 may include a lid 313 for opening and closing the detergent box 300.

The inside of the detergent box 300 may be opened when the lid 313 is pulled up or rotated.

The connection portion 400 may include a first connection pipe 410 communicating with a lower portion of the detergent box 300, a second connection pipe 420 communicating with an upper portion of the tub body 41, and a communication hose 430 allowing the first connection pipe 410 and the second connection pipe 420 to communicate with each other. The second connection pipe 420 may be a pipe extending from the outer circumferential surface of the tub through hole 414 to the outside of the tub body 41.

The communication hose 430 may be made of a rubber material and thus ensure the first connection pipe 410 and the second connection pipe 420 stably communicate with each other even when the drum 5 and the tub 4 vibrate.

Hereinafter, the structure of the detergent box 300 will be described in detail with reference to FIG. 4.

The detergent box 300 may be arranged at a position higher than the maximum level of water accommodated in the tub body 41 without any other device, and the connection portion 400 may be arranged at the lower end of the detergent box 300. In this case, if the detergent stored in the detergent box 300 is a liquid detergent, the detergent may be introduced into the tub 4 through the connection portion 400 irrespective of whether the drum 5 is rotated.

Accordingly, in order to prevent such introduction, the detergent box 300 may have a structure which discharges water and the detergent from the detergent box 300 to the connection pipe 410 using the siphon effect when water more than a reference amount is introduced through the connection portion 400.

Accordingly, even when a liquid detergent is provided in the detergent box 300, the detergent may be prevented from being discharged by its own weight into the connection pipe 410 before the amount of water exceeds the reference amount.

Here, the reference amount may be defined as the minimum amount of water that may cause a siphon effect in the detergent box 300.

The detergent box 300 may include a body portion 320 configured to provide a space for storing the detergent and having an opening 323 at the top thereof, a housing 310 in which the body portion is detachably accommodated, and a housing through hole 311 communicating with the connection portion 400 through a lower portion of the body portion 320. The body portion 320 may include a discharge pipe 321 protruding from a lower portion of the body portion 320 toward the opening 323 and provided therein with a hollow allowing the housing 310 and the body portion 320 to communicate with each other, and a discharge pipe cover 322 into which a part of the discharge pipe 321 is inserted to guide the water and detergent into the hollow when the amount of water introduced into the body portion 320 is greater than or equal to a reference amount.

When the body portion 320 is accommodated in the housing 310, the opening 323 of the body portion 320 may be arranged below the upper end of the side surface of the housing 310.

The housing 310 may be provided with a housing coupling portion 312 to be coupled to either the drawer 3 or the cabinet 2.

The housing coupling portion 312 may be a plate extending from at least one of a side surface and a bottom surface of the housing 310.

The housing coupling portion 312 may have a hollow therein so as to be coupled with a bolt or the like.

Accordingly, the body portion 320 may be stably accommodated in the housing 310, Water rising along the side surface of the housing 310 may flow into the opening 323 of the body portion 320.

Hereinafter, introduction of water from the tub 4 into the detergent box 300 and discharge of water and the detergent back to the tub 4 will be described with reference to FIGS. 4(*b*) and 4(*c*).

When the drum 5 rotates at a first revolutions per minute (rpm), the water accommodated in the tub 4 rises up to the position where the tub through hole 412 provided in the inner circumferential surface of the tub 4 is arranged.

When the drum 5 rotates at a speed higher than or equal to the first rpm, water in the tub 4 is introduced into the housing through hole 311 through the connection portion 400 via the tub through hole 414. Here, the first rpm may be defined as an rpm at which the water accommodated in the tub 4 rises up to the tub through hole 412 provided in the tub body 41.

The tub through hole 412 may be provided at a position where water contacts the tub body 41 when the drum 5 rotates at the first rpm.

Thereafter, when the drum 5 rotates at a second rpm higher than the first rpm, the water in the tub 4 may further rise up the inner circumferential surface (the tub body) of the tub. Thus, the water may contact the lower end of the discharge pipe 321 provided at the lower portion of the body portion. That is, it may be construed that the discharge pipe 321 is provided at a height at which the pipe contacts water when the drum 5 rotates at the second rpm, and is spaced apart from the housing through hole 311 by a difference between the level of water introduced when the drum 5 rotates at the first rpm and the level to which the water rises when the drum 5 rotates at the second rpm.

The water level that water introduced into the housing 310 reaches when the drum 5 rotates at the second rpm, may be defined as a first (1st) level.

When the drum 5 rotates at a third rpm higher than the second rpm, the water inside the tub 4 is further moved to the inner circumferential surface (tub body) of the tub by stronger centrifugal force and thus a larger amount of water is introduced into the housing 310.

Accordingly, when the drum 5 rotates at the third rpm, the water in the tub 4 flows into the housing 310 through the connection portion 400 and rises up to the free end of the discharge pipe 321. That is, the water supplied to the housing 310 comes into contact with the discharge pipe cover 322.

When the drum 310 rotates at the third rpm or a higher speed, the water supplied to the housing 310 flows into the body portion 320 through the discharge pipe 321 and the discharge pipe cover 322.

In the body portion 320, the detergent is stored at a second (2nd) level that is higher than the first level and lower than the free end of the discharge pipe 321 or the upper end portion of the discharge pipe cover 322.

When the water is supplied to the body portion 320, the water and the detergent are mixed, and the level of the water and detergent in the body portion 320 further rises up to a third (3rd) level corresponding to the free end of the discharge pipe 321 or the upper end portion of the discharge pipe cover.

Then, when the drum 5 is rotated at a speed lower than the third rpm or is stopped, the water accommodated in the body portion 320 begins to be discharged through the free end of the discharge pipe 321 via the inner circumferential surface of the discharge pipe cover 322 and the outer circumferential surface of the discharge pipe 321. At this time, the siphon effect occurs, and thus the detergent and water accommodated in the body portion 320 are entirely discharged to the housing 310 through the discharge pipe 321. The water and the detergent accommodated in the housing 310 are discharged to the tub 4 through the connection portion 400 via the housing through hole 311.

Thus, the detergent box 300 may be automatically supplied with water from the tub 4 and discharge the supplied water to the tub 4 without any means for supplying water through the water supply pipe or a control means for controlling discharge of the detergent.

FIG. 4(*c*) shows another embodiment of the detergent box 300.

Since the body portion 320 is detachably provided in the housing 310, a predetermined space may be provided between the outer circumferential surface of the body portion 320 and the inner circumferential surface of the housing 310. That is, the body portion 320 may be spaced apart from the housing 310 by a predetermined distance.

When the body portion 320 is accommodated in the housing 310, the side surface of the housing 310 may be arranged higher than the opening 323.

If water supplied to the housing 310 is immediately introduced into the discharge pipe 321, the water may not be properly mixed with the detergent accommodated in the body portion 320. Accordingly, a buoyancy type body check valve 324 may be provided under the discharge pipe 321.

The body check valve 324 may be made of a rubber material that may completely close the hollow of the discharge pipe 321 and may be rotatably hinged to the lower portion of the body portion 320.

The body check valve 324 may be a buoyancy type check valve having a specific gravity less than that of water.

Thus, when the drum 5 rotates at the second rpm, the water supplied to the housing 310 reaches the first (1st) level, and buoyancy may be applied to the body check valve 324 to close the discharge pipe 321. Thereafter, when the drum 5 starts to rotate at the third rpm or a higher speed, the water supplied to the housing 310 may begin to rise along the outer circumferential surface of the body portion 320 and flow into the body portion 320 through the opening 323.

The water introduced into the body portion 320 through the opening 323 may be entirely mixed with the detergent contained at the second (2nd) level in the body portion 320. When the supplied water reaches the third (3rd) level, the siphon effect may occur.

Thereafter, when the drum 5 is slowed from the third rpm to the second rpm or a lower speed or is stopped, the water and the detergent accommodated in the body portion 320 flows into the free end of the discharge pipe 321 along the discharge pipe cover 322 and the outer circumferential surface of the discharge pipe 321 and comes into contact with the body check valve 324.

The body check valve 324 opens the discharge pipe 321 due to the weight of the water and the detergent. The water and the detergent may all pass through the discharge pipe 321 and be discharged to the tub 4 through the housing through hole 311 along the connection pipe 410.

FIG. 5 shows installation positions of the detergent box 300 and the tub 4, and installation heights of the discharge pipe 321 and the discharge pipe cover 322 of the detergent box 300.

The detergent box 300 is provided at a position higher than the maximum level that water in the tub body 41 reaches when the drum 5 is stopped, and the second connection pipe 430 communicating with the tub through hole 412 is arranged at an upper portion of the tub body 41.

Here, as described above, the tub through hole 412 and the second connection pipe 430 may be arranged at a water level at which water in the tub 4 can contact the tub body 41 when the drum rotates at the first rpm. The first connection pipe 410 may be arranged at a lower portion of the detergent box 300, and the lower portion of the discharge pipe 321 may be arranged at a height (1st level) which the water supplied to the housing 310 reaches when the drum 5 rotates at the second rpm. The free end of the discharge pipe 321 and the upper portion of the discharge pipe cover 322 are arranged at a height (3rd level) which water supplied to the housing 310 reaches when the drum 5 rotates at the third rpm.

Hereinafter, the structure of the tub 4 for accurately supplying water to the housing 310 according to the rpm of the drum 5 will be described in detail with reference to FIGS. 6 and 7.

When the drum 5 rotates in the tub 4, the drum 5 may momentarily severely vibrate due to, for example, maldistribution of clothes. The momentary sever vibration of the drum 5 may cause water accommodated in the tub 4 to momentarily gather in a space between the tub body 41 and the tub cover 43. As a result, a large amount of water may be momentarily supplied to the housing 310, causing an unexpected siphon effect in the body portion 320.

Accordingly, it may be necessary to provide a configuration in which water is supplied to the detergent box 300 only by a constant rise of the water level in the tub 4 that is generated by rotation of the drum 5, not by vibration of the drum 5.

FIG. 6 shows an insertion portion 435 which may be provided in the tub cover 43 to cause water to be supplied to the detergent box 300 only by a constant water level rise in the tub 4 generated by rotation of the drum 5.

The tub cover 43 may include a cover body 434 positioned at the top of the tub body 41 to form a top surface of the tub body 41, and an insertion portion 435 protruding from an outer circumferential surface of the cover body 434 and contacting the inner circumferential surface of the tub body 41.

The tub body 41 includes a first protrusion 415 formed on an upper portion of the outer circumferential surface thereof and a second protrusion 417 spaced apart from the first protrusion 417. The tub cover 43 includes a first fastening portion 437 inserted into and fastened to a gap between the first protrusion and the second protrusion, and a second fastening portion 417 spaced apart from the first fastening portion and seated on the outer circumferential surface of the second protrusion 417. Thus, the tub body 41 and the tub cover 43 are coupled to each other.

The insertion portion 435 may be spaced apart from the first fastening portion 437 so as to face the center of the tub 4 and protrude toward the bottom surface of the tub 4.

Specifically, when the tub body 41 and the tub cover 43 are coupled to each other, the insertion portion 435 may be spaced apart from the tub body 41 by a predetermined distance so as to face the position where the drum 5 is arranged in the tub body 41 and may protrude to a distance long enough to shield the tub through hole 412.

Accordingly, even when vibration occurs in the drum 5 to cause the water in the tub 4 to rise toward the tub through hole 412 to generate a swell, the insertion portion 435 may block the swell, thereby preventing water from being discharged from the tub through hole 412.

That is, only when the drum 5 rotates and the water accommodated in the tub 4 rises to the tub body 41 such that the water level is maintained, the water accommodated in the tub may flow into the gap between the tub body 41 and the insertion portion 435 and be discharged through the second connection pipe 430.

This may prevent the water accommodated in the tub 4 from being unintentionally introduced into the detergent box 300, thereby preventing the siphon effect from occurring in the detergent box 300.

FIG. 7 shows a resistive rib that may be provided to the tub body 41 to cause water to be supplied to the detergent box 300 only by a constant water level rise in the tub 4 generated by rotation of the drum 5.

The inner circumferential surface of the tub 4 may be provided with first resistive ribs 413 protruding from both sides of the surface having the tub through hole 412 to generate resistance against water rotating along the inner circumferential surface of the tub such that water can flow into the tub through hole 412 only when the drum rotates at the first rpm or a higher speed.

That is, when the drum 5 rotates at a speed lower than the first rpm, and the water accommodated in the tub 4 temporarily contacts the inner circumferential surface of the tub body 41 due to momentary vibration of the drum 5, the first resistive ribs 413 may reduce the kinetic energy of the water.

Accordingly, the first resistive ribs 413 may prevent the water accommodated in the tub 4 from unintentionally flowing into the tub through hole 412 and moving to the detergent box 300.

In addition, when the drum 5 temporarily rotates at the first rpm or a higher speed, the first resistive ribs 413 may resist against the water moving along the inner circumferential surface of the tub body 41, thereby preventing the water from being discharged to the tub through hole 412.

The inner circumferential surface of the tub may further include a second resistive rib 414 arranged under the tub through hole 412 and protruding toward the bottom surface of the tub. Here, the second resistive rib 414 may be arranged in parallel with the first resistive ribs 413.

The first resistive ribs 413 and the second resistive rib 414 may collide with water moving in contact with the tub body 41 to reduce the kinetic energy of the water, and may also serve to hold a part of the water so as not to rotate, using the surface tension.

Thereby, even when the drum 5 temporarily rotates at a speed higher than or equal to the first rpm or a speed lower than the first rpm, and excessive vibration occurs in the drum 5 to cause the water in the tub 4 to gather in the tub body 41 and rise up, the first resistive ribs 413 and the second resistive rib 414 may effectively prevent the water from being discharged into the tub through hole 412.

In addition, the first resistive ribs 413 and the second resistive rib 414 may allow the water to be supplied to the detergent box 300 only when the drum 5 persistently rotates at the first rpm or a higher speed. Accordingly, the rpm of the drum 5 may be precisely controlled to allow water to flow into the detergent box 300 at an appropriate time to supply the detergent to the tub 4.

Since the body portion 320 and the housing 310 are detachably provided to the detergent box 300 shown in FIG. 4, there may be a certain gap between the body portion 320 and the housing 310.

Accordingly, in the case of FIG. 4(*b*), when a large amount of water is supplied to the housing 310, a part of the water may flow into the discharge pipe 321, but the remaining water may flow into a space between the inner circumferential surface of the housing 310 and the outer circumferential surface of the body portion 320. Then, the water introduced into the space between the inner circumferential surface of the housing 310 and the outer circumferential surface of the body portion 320 may rise to a position at or above the first (1st) level. When more water is supplied to the housing 310, the water may be introduced into the body portion 320 through the opening 323. Thereafter, when rotation of the drum 5 is stopped or slowed to the second rpm or a lower speed, the siphon effect occurs in the body portion 320 and the detergent and water are discharged through the discharge pipe 321. At the same time, the water introduced into the space between the housing 310 and the body portion 320 begins to descend.

Here, when all the water introduced into the space between the housing 310 and the body portion 320 descends and the water level is lowered to or below the first (1st) level, the detergent and water discharged from the discharge pipe 321 due to the siphon effect temporarily undergoes interruption of the siphon effect.

That is, when the water introduced into the space between the housing 310 and the body portion 320 descends due to decrease of the rpm of the drum 5 to the second rpm or a lower speed, the siphon effect is persistently maintained in the discharge pipe 321 and the detergent and the water are discharged together to the discharge pipe 321 until the water comes into contact with the outlet portion of the discharge pipe 321, which is immediately before the first (1st) level.

However, when all the water introduced into the space between the housing 310 and the body portion 320 descends to or below the first (1st) level and begins to be separated from the lower end (outlet) of the discharge pipe 321, a pressure change temporarily occurs at the lower end (outlet) of the discharge pipe 321, and the siphon effect is interrupted.

The interrupted siphon effect occurs again when the water level in the housing 310 falls to or below the first (1st) level and the pressure at the lower end of the discharge pipe 321 remains unchanged. However, the amount of fluid discharged by the siphon effect is smaller than before the siphon effect was interrupted, and accordingly a certain amount of detergent and water may be retained in the body 310.

Even in the case of FIG. 4(*c*), when a large amount of water is supplied to the housing 310, the water is blocked by the body check valve 324 from flowing into the discharge pipe 321, and may be introduced into the space between the inner circumferential surface of the housing 310 and the outer circumferential surface of the body portion 320 and moved to the opening 323.

Thereafter, when a large amount of water is introduced through the opening 323 and rises up to the third (3rd) level and the rpm of the drum 5 is reduced, the siphon effect occurs, and the detergent and water in the body portion 320 begins to be discharged into the discharge pipe 321. At the same time, the level of the water introduced into the space between the outer circumferential surface of the body portion 320 and the inner circumferential surface of the housing 310 is lowered because water is discharged from the housing 310.

Here, when the level of the water introduced into the space between the inner circumferential surface of the housing 310 and the outer circumferential surface of the body portion 320 is lowered and the water level in the housing 310 is lowered to the first (1st) level or a lower level, contact between the lower end (outlet) of the discharge pipe 321 and the water stored in the housing 310 is broken and the siphon effect in the discharge pipe 321 is momentarily interrupted.

That is, at the moment when the water having risen in the housing 310 to or above the first (1st) level and flowed into the space between the outer circumferential surface of the body 310 and the inner circumferential surface of the housing 320 is lowered to or below the first (1st) level, a pressure change occurs at the lower end (outlet) of the discharge pipe 321. Thereby, the siphon effect in the discharge pipe 321 is interrupted and discharge of the water and the detergent is temporarily interrupted.

Thereafter, when the water level in the housing 310 is lowered and the pressure at the lower end (outlet) of the discharge pipe 321 is maintained, the siphon effect occurs again, and the detergent and the water in the body portion 320 are discharged into the discharge pipe 321 again.

However, the restarted siphon effect is weaker than the siphon effect before the interruption, and thus a certain amount of water and detergent remains in the body portion 320.

Accordingly, to persistently keep the siphon effect in the discharge pipe 321 uninterrupted, the pressure at the lower end (outlet) of the discharge pipe 321 needs to be kept constant.

To this end, the lower end of the discharge pipe 321 needs to be maintained not to contact water because the pressure will not be changed by the change in water level in the housing 310 if the lower end the discharge pipe 321 does not contact the water from the beginning.

FIG. 8 illustrates an embodiment in which a block unit is additionally provided to prevent water supplied into the housing 310 from contacting the lower end of the discharge pipe 321.

Like the detergent box 300 shown in FIG. 4, the detergent box 300 may include a body portion 312 configured to provide a space for storing a detergent and having an opening at the top thereof, a housing 310 in which the body portion is detachably accommodated, a housing through hole 311 penetrating a lower portion of the housing such that water is introduced or the detergent and water are discharged together therethrough, a discharge pipe 321 protruding from a lower portion of the body toward the opening and provided therein with a hollow for discharging the detergent, and a discharge pipe cover 322 into which a part of the discharge pipe is inserted to guide water and the detergent into the hollow when the amount of water introduced into the body portion is greater than or equal to a reference amount. The detergent box may further include a block unit configured to communicate with the discharge pipe 321 and provide a certain space between the lower portion of the body portion 320 and the bottom surface of the housing 310 to prevent water introduced into the housing 310 from contacting the discharge pipe 321.

The block unit 330 may include a block body 331 accommodated in the housing 310, at least a part of the body portion 320 being accommodated in the block body, and a block through hole 332 formed in a bottom surface of the block body 331 such that the detergent discharged from the discharge pipe 321 is discharged into the housing 310.

The block unit 330 may further include a block check valve 333 arranged outside the bottom surface of the block body 331 to shield the block through hole 332.

The block check valve 333 may be a buoyancy type check valve. Thus, when the water in the housing 310 is introduced and brought into contact with the block check valve 333, the block check valve 333 may close the block through hole 332.

The block check valve 333 may be hinged to the lower surface of the block body 331 or may be fixedly arranged.

That is, the block check valve 333 may be coupled in any structure as along as it keeps the block through hole 332 open at normal times and is caused to close the block through hole 332 by buoyancy when water is introduced into the housing 310 and brought into contact with the block check valve. The block check valve 333 may be made of a rubber material.

In addition, for coupling between the body portion 320 and the block unit 330, a body coupling portion 325 may be provided to the lower end of the body portion 320, and a block coupling portion 336 capable of being coupled with the body coupling portion 325 may be provided on the bottom surface of the block unit 330.

The block coupling portion 336 may be formed as a groove into which the body coupling portion 325 is press-fitted.

Thus, the block body 331 may accommodate the body portion 320 from the outside and provide a predetermined space between the bottom surface of the body portion 320 and the bottom surface of the block body 331, such that water introduced into the housing 310 may be prevented from flowing into the predetermined space.

That is, the block body 331 may be configured such that only air can be contained in the space between the lower surface of the body portion 320 and the bottom surface of the block body, and the water supplied into the housing 310 cannot be introduced into the space.

Hereinafter, a structure in which the siphon effect may be kept uninterrupted in the discharge pipe 321 through the block unit 330 will be described with reference to FIG. 9.

Referring to FIG. 9(*a*), the drum 5 is rotated at a speed higher than or equal to the first rpm and lower than or equal to the second rpm, and thus water starts to flow into the housing 310.

Referring to FIG. 9(*b*), water introduced into the housing 310 starts to further rise in the housing 310 and pushes up the block check valve 331 to close the lower end (outlet) of the discharge pipe 321.

Thereafter, when the drum 5 is rotated at a speed higher than the second rpm, more water flows into the housing 310, and thus the water rises in the space between the body portion 320 and the housing 310. Here, the water introduced into the housing 310 cannot flow into the block unit 330, and accordingly the lower portion of the discharge pipe 321 does not contact the water.

Referring to FIG. 9(*c*), the drum 5 is rotated at a speed higher than the third rpm, and thus water introduced into the housing 310 flows into the body 310 through the opening 323 and is supplied until the water reaches the third (3rd) level.

Referring to FIG. 9(*d*), the siphon effect occurs in the discharge pipe 321, and thus the detergent and water in the body portion 320 are discharged to the block unit 330. The detergent and water discharged to the block unit 330 press the check valve 331 by their own weights. Then, when the water level in the housing 310 is lowered, the check valve 331 is opened, and both the water and the detergent in the block unit 330 are discharged to the tub 4 through the first connection pipe 410 via the housing through hole 311.

In this process, when the siphon effect occurs in the discharge pipe 321, the pressure at the lower end (outlet) of the discharge pipe 321 is kept unchanged by the block unit 330, and accordingly the siphon effect may be continued without being interrupted.

Accordingly, the water and detergent may be entirely discharged to the tub 4 by the block unit 330 without any water or detergent remaining in the body 310.

FIG. 10 illustrates another embodiment of the block unit 330.

The block unit 330 of FIG. 10 does not fully accommodate the body portion 320, unlike the block unit of FIG. 9, but is configured to accommodate only a part of the body portion that is provided with the discharge pipe 321.

Specifically, the block unit 330 may include a block barrel 334 extending from a lower end of the body portion 320 having the discharge pipe 321. The block barrel 334 may include a communication hole provided at one end to communicate with the discharge pipe 321 and a block through hole 332 provided at an opposite end to communicate with the housing 310.

A block check valve 333 configured to open and close the block through hole 332 may be provided on the outer circumferential surface of the block through hole 332.

Similarly, the block unit 330 shown in FIG. 10 may prevent change in pressure at the outlet (lower end) of the discharge pipe 321 to prevent the discharge pipe 321 from making a direct contact with water introduced into the housing 310.

Accordingly, the water introduced into the housing 310 may raise the block check valve 333 to close the block through hole 332 and may flow into the opening 323 to generate and persistently maintain the siphon effect in the discharge pipe 321.

Accordingly, the block unit 330 may cause all the water and detergent in the body portion 320 to be discharged to the housing 310.

On the basis of the above-described configuration, the laundry treating apparatus of the present invention may include a water supply step S1 of supplying water to the tub 4, a washing step S2 of rotating the drum 5 at an rpm lower than the first rpm, and a detergent box water supply step S3 of rotating the drum at an rpm higher than or equal to the first rpm to move a part of water stored in the tub corresponding to a reference amount or a larger amount to the detergent box 300, the detergent box water supply step being initiated before or during the washing step.

Here, the first rpm is set to an rpm at which centrifugal force causing at least a part of the water stored in the tub 4 to rise up even in the detergent box through the connection portion 400 is provided to the water. Specifically, a third rpm, which is higher than the first rpm, may be set as an rpm at which the siphon effect occurs in the detergent box. The rpm higher than or equal to the first rpm may correspond to an rpm higher than or equal to the third rpm. Further, the reference amount may be set to the amount of water at which the siphon effect starts to occur in the detergent box.

The washing step may include a first washing step S2-1 of rotating the drum 5 at an rpm lower than the first rpm to create a water stream in the tub, a drainage step S2-2 of discharging the water stored in the tub 4 after completion of the first washing step, a second water supply step S2-3 of supplying water to the tub 5 after completion of the drainage step, and a second washing step S2-4 of rotating the drum at an rpm lower than the first rpm to create a water stream in the tub.

The detergent box water supply step S3 may include a step of determining a time at which the detergent can be introduced into the tub 4, and then supplying the detergent to the tub 4 when the time is reached.

The time at which the detergent can be introduced into the tub 4 may be a time before the first washing step S2-1 is initiated if a detergent for removing foreign substances from clothes is accommodated in the detergent box 300, or correspond to the second washing step S2-3 if a fabric softener for increasing the degree of flexibility of the clothes is accommodated in the detergent box 300.

The water supply step S1 is a step of supplying water to the tub 4 such that a water level higher than the bottom surface of the drum 5 is maintained.

If a detergent for removing foreign substances from the clothes is accommodated in the detergent box 300, the detergent box water supply step S3 may be performed before the first washing step S2-2 is initiated after completion of the water supply step.

Since the detergent box water supply step S3 is performed before initiation of the first washing step when the detergent box 300 contains the detergent, the detergent may be supplied to the tub 4 before the first washing step S2-1. Accordingly, foreign substances may be removed from the clothes with the detergent and water in the first washing step S2-1.

That is, the first washing step S2-1 may be understood as a step of separating foreign substances from the clothes using the detergent stored in the detergent box 300.

The second water supply step S2-3 is a step of supplying water to the tub again such that a water level higher than the bottom surface of the drum is maintained.

When a detergent for removing foreign substances from the clothe is accommodated in the detergent box 300, the second water supply step S2-3 may be understood as a step of supplying water for the rinsing cycle of washing away the detergent and foreign substances from the clothes.

When a fabric softener for increasing the degree of flexibility of the clothes is accommodated in the detergent box 300, the detergent box water supply step S3 may be performed before the second washing step S2-4 is initiated after completion of the second water supply step S2-3.

Accordingly, since the detergent box water supply step is performed before initiation of the second washing step S2-4 when the fabric softener is contained in the detergent box 300, the second washing step S2-4 may be provided as a step of supplying the fabric softener stored in the detergent box to the tub to increase the degree of flexibility of the clothes.

Accordingly, the second washing step S2-4 may be set as a step of increasing the degree of flexibility of the clothes by supplying the detergent stored in the detergent box to the tub.

The laundry treating apparatus 100 of the present invention may omit the water supplying means which communicates with the water supply unit 7 to separately supply water to the detergent box 300. That is, the detergent contained in the detergent box 300 may be automatically discharged to the tub 4 by controlling the rpm of the drum 5 alone in order to separate foreign substances from the clothes or to increase the degree of flexibility of the clothes.

The present invention may be embodied in various forms without departing from the scope of the invention. Accordingly, it is intended that the present invention cover the modifications and variations of this invention provided they come within the scope of the appended claims and their equivalents.

The invention claimed is:

1. A detergent box for a laundry treating apparatus including a tub and a drum, the detergent box comprising:

a body portion that defines a detergent space configured to store detergent, the body portion having a body opening defined at a top surface of the body portion;

a housing configured to accommodate the body portion, the housing defining a housing through-hole disposed at a lower portion of the housing and configured to receive water introduced from the tub and to discharge the water and the detergent;

a discharge pipe that extends from a lower portion of the body portion toward the body opening, the discharge pipe having a hollow portion configured to discharge detergent;

a discharge pipe cover configured to guide water and detergent into the hollow portion of the discharge pipe based on an amount of water flowed into the body portion by rotation of the drum being greater than or equal to a reference amount, at least a part of the discharge pipe being inserted into the discharge pipe cover; and a block unit that is configured to communicate with the discharge pipe, that defines a predetermined space between the lower portion of the body portion and a bottom surface of the housing, and that is configured to restrict water in the housing from flowing into the discharge pipe.

2. The detergent box of claim 1, wherein the block unit comprises:

a block body that is accommodated in the housing and that accommodates at least a part of the body portion, the block body defining a block through-hole disposed at a bottom surface of the block body and configured to discharge, into the housing, detergent received from the discharge pipe.

3. The detergent box of claim 2, wherein the block unit further comprises:

a block check valve disposed outside the bottom surface of the block body and configured to cover the block through-hole.

4. The detergent box of claim 3, wherein the block check valve comprises a buoyancy type check valve, a specific gravity of the block check valve being less than a specific gravity of water.

5. The detergent box of claim 4, wherein the block check valve is made of a rubber material.

6. The detergent box of claim 2, wherein the block unit comprises:

a block barrel that is disposed vertically below the lower portion of the body portion and that faces the discharge pipe, and wherein the block barrel has a first end that defines a communication hole configured to communicate with the discharge pipe, and a second end that defines a block through-hole configured to communicate with the housing.

7. The detergent box of claim 6, wherein the block unit further comprises:

a block check valve disposed outside a bottom surface of the block barrel and configured to cover the block through-hole.

8. The detergent box of claim 2, wherein an outer circumferential surface of the body portion and a side surface of the housing are spaced apart from each other to define a gap in a state in which the body portion is accommodated in the housing, wherein the side surface of the housing extends to a position higher than the body opening and is configured to allow water to flow into the body portion through the body opening, and wherein the body portion is configured to receive, through the body opening, water guided from the housing through the gap defined between the outer circumferential surface of the body and the side surface of the housing.

9. A laundry treating apparatus comprising:

a tub that defines a tub space configured to receive water, the tub defining a tub through-hole at an inner circumferential surface of the tub;

a drum rotatably disposed in the tub and configured to receive clothes;

a detergent box disposed outside the tub, the detergent box defining a detergent space configured to receive detergent and to receive water from the tub; and a connection portion having a first side configured to communicate with the tub through-hole and a second side configured to communicate with the detergent box, the connection portion being configured to, based on rotation of the drum, guide at least a portion of water moving along the inner circumferential surface of the tub into the detergent box and to discharge detergent and water mixed in the detergent box to the inner circumferential surface of the tub, wherein the detergent box comprises:

a body portion that defines the detergent space, the body portion having a body opening defined at a top surface of the body portion, a housing configured to accommodate the body portion and to communicate with the connection portion, the housing defining a housing through-hole disposed at a lower portion of the housing and configured to receive water introduced from the tub and to discharge the water and the detergent, a discharge pipe that extends from a lower portion of the body portion toward the body opening, the discharge pipe having a hollow portion that allows communication between the housing and the body portion, a discharge pipe cover configured to guide water and detergent into the hollow portion of the discharge pipe based on an amount of water flowed into the body portion by rotation of the drum being greater than or equal to a reference amount, at least a part of the discharge pipe being inserted into the discharge pipe cover, and a block unit that is configured to communicate with the discharge pipe, that defines a predetermined space between a lower portion of the body and a bottom surface of the housing, and that is configured to restrict water in the housing from contacting the discharge pipe.

10. The laundry treating apparatus of claim 9, wherein the block unit comprises:

a block body that is accommodated in the housing and that accommodates at least a part of the body portion, the block body defining a block through-hole disposed at a bottom surface of the block body and configured to discharge, into the housing, detergent received from the discharge pipe.

11. The laundry treating apparatus of claim 10, wherein the block unit further comprises:

a block check valve disposed outside the bottom surface of the block body and configured to cover the block through-hole.

12. The laundry treating apparatus of claim 11, wherein the block check valve comprises a buoyancy type check valve, a specific gravity of the block check valve being less than a specific gravity of water.

13. The laundry treating apparatus of claim 12, wherein an outer circumferential surface of the body portion and a side surface of the housing are spaced apart from each other by a predetermined distance to define a gap in a state in which the body portion is accommodated in the housing, wherein the side surface of the housing extends to a position higher than the body opening and is configured to allow water to flow into the body portion through the body opening, and wherein the body portion is configured to receive, through the body opening, water guided from the housing through the gap defined the outer circumferential surface of the body and the side surface of the housing.

14. The laundry treating apparatus of claim 9, wherein the detergent box is disposed at a position higher than a maximum water level that the tub is configured to hold in a state in which the drum is stopped.

15. The laundry treating apparatus of claim 14, wherein the detergent box is configured to discharge detergent and water from the detergent box to the connection portion by a siphon effect based on an amount of water introduced into the detergent box through the connection portion being greater than or equal to a reference amount.

16. The laundry treating apparatus of claim 15, wherein the connection portion is configured to, based on a rotation speed of the drum being greater than or equal to a first revolutions per minute (RPM), receive water in the tub and supply the received water into the detergent box.

17. The laundry treating apparatus of claim 16, wherein the tub through-hole is defined at a height in the tub corresponding to a water level raised in the tub based on the drum rotating at the first RPM.

18. The laundry treating apparatus of claim 9, wherein the tub comprises first resistive ribs that protrude from the inner circumferential surface of the tub and that are disposed at both sides of the tub through-hole, the first resistive ribs being configured to apply resistance against water rotating along the inner circumferential surface of the tub and to allow water to flow into the tub through-hole based on a rotation speed of the drum being greater than or equal to a reference RPM.

19. The laundry treating apparatus of claim 18, wherein the tub further comprises a second resistive rib that is disposed on the inner circumferential surface at a position vertically below the tub through-hole and that extends toward a bottom surface of the tub.

20. The laundry treating apparatus of claim 9, wherein the block unit comprises:

a block barrel that is disposed vertically below the lower portion of the body portion and that faces the discharge pipe, and wherein the block barrel has a first end that defines a communication hole configured to communicate with the discharge pipe and a second end that defines a block through-hole configured to communicate with the housing.

21. The laundry treating apparatus of claim 20, wherein the block unit further comprises:

a block check valve disposed outside a bottom surface of the block barrel and configured to cover the block through-hole.

22. The laundry treating apparatus of claim 9, further comprising:

a cabinet that defines a cabinet opening at a surface of the cabinet;

a drawer body configured to accommodate the tub and the drum; and a drawer panel disposed at the drawer body and configured to open and close the cabinet opening, wherein the detergent box is disposed at the drawer panel.

* * * * *